United States Patent [19]

DeSantis

[11] Patent Number: 4,785,983

[45] Date of Patent: Nov. 22, 1988

[54] UNIVERSAL HOLSTER

[76] Inventor: Eugene DeSantis, 149 Denton Ave., New Hyde Park, N.Y. 11040

[21] Appl. No.: 172,956

[22] Filed: Mar. 23, 1988

Related U.S. Application Data

[63] Continuation of Ser. No. 943,062, Dec. 18, 1986, abandoned.

[51] Int. Cl.[4] ..... A45F 5/00

[52] U.S. Cl. ..... 224/206; 224/911

[58] Field of Search ..... 224/911, 206, 192, 230, 224/240, 151; D3/2

[56] References Cited

U.S. PATENT DOCUMENTS

| | | | |
|---|---|---|---|
| D. 259,946 | 6/1981 | Bianchi et al. . | |
| D. 259,947 | 8/1981 | Bianchi et al. . | |
| 2,410,640 | 11/1946 | Engle | 224/911 X |
| 3,168,972 | 3/1965 | Parlante et al. . | |
| 3,276,646 | 10/1966 | Coggins, Jr. | 224/911 X |
| 3,583,611 | 2/1971 | Theodore . | |
| 4,029,242 | 7/1977 | Stoesser . | |
| 4,068,784 | 1/1978 | Angell | 224/206 X |
| 4,084,734 | 1/1978 | Bianchi et al. . | |
| 4,258,871 | 4/1981 | McMahon . | |
| 4,270,680 | 6/1981 | Bianchi | 224/911 X |
| 4,298,150 | 11/1981 | Seldeen | 224/911 X |
| 4,346,827 | 8/1982 | Bianch et al. | 224/206 |
| 4,378,082 | 3/1983 | Chica | 224/911 X |
| 4,408,706 | 10/1983 | Hurley | 224/911 X |
| 4,410,118 | 4/1983 | Taurisano . | |
| 4,577,787 | 3/1986 | Hersey | 224/911 X |

*Primary Examiner*—Henry J. Recla
*Assistant Examiner*—Robert Petrik
*Attorney, Agent, or Firm*—Nixon & Vanderhye

[57] ABSTRACT

A universal holster assembly for receiving a handgun body which forms a handgun receiving pocket including a muzzle portion, hammer portion and trigger portion. A snap-on fastener is provided at each of the muzzle, hammer and trigger portions for mating engagement with snap fasteners provided on associated mounting devices which enable the holster to be worn under the arm as part of a shoulder harness unit, directly on the belt, or suspended from the belt but inside the trousers.

20 Claims, 2 Drawing Sheets

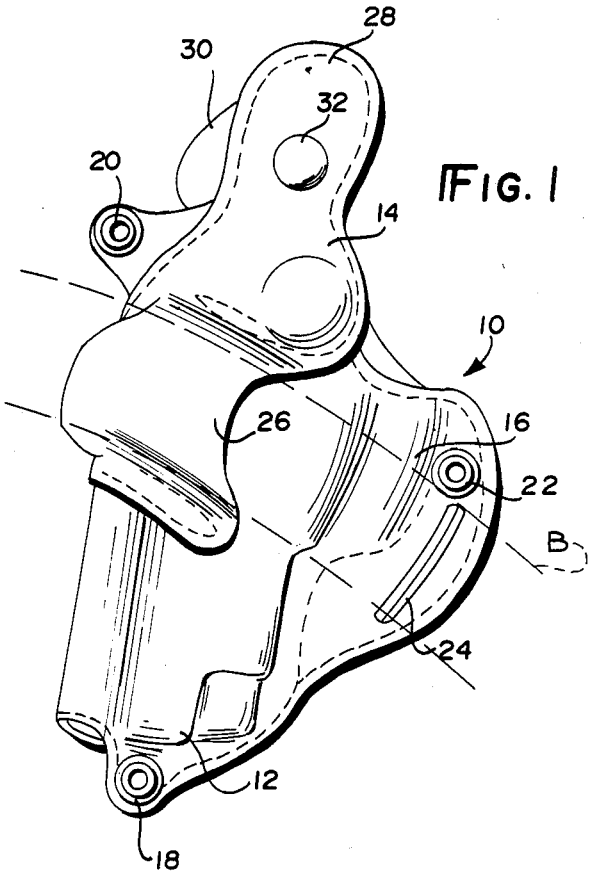
FIG. 1
FIG. 4
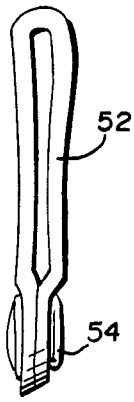
FIG. 5
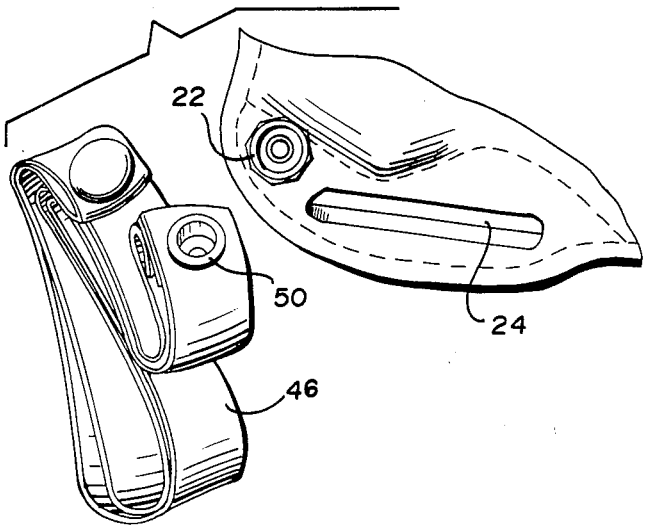
FIG. 6
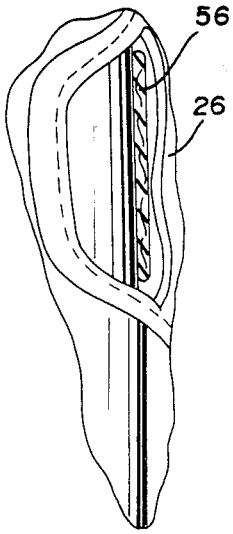

UNIVERSAL HOLSTER

This is a continuation of application Ser. No. 943,062, filed Dec. 18, 1986, now abandoned.

BACKGROUND OF THE INVENTION

This invention relates to improved holsters for handguns and, more specifically, to an easily attachable universal holster assembly which enables the user to wear the holster in any of three substantially concealed positions.

There are numerous patents in the prior art detailing various ways of affixing a single holster in a variety of positions. For example, in U.S. Pat. No. 4,410,118, a universal holster assembly is disclosed which permits the holster to be worn in any of three concealed modes, i.e., on the hip, on the lower leg or under the arm. The holster, however, does not have the same degree of flexibility in terms of anchoring options and ease of conversion from one carrying mode to another, nor does it allow for carrying a handgun suspended from the user's belt, but concealed from view, i.e., inside the trousers.

Another prior art holster which can be worn in connection with a shoulder unit or on a belt is disclosed in U.S. Pat. No. 4,084,734. Here again, however, the anchoring or attachment points are limited and the holster itself is of relatively complex construction.

In U.S. Pat. No. 4,258,871, a universal holster assembly is disclosed which permits the holster to be worn under the arm, or attached to either leg. It does not, however, have any provision for attachment to a belt so that the holster can be worn inside the trousers.

Other combined belt and shoulder holster units are disclosed in U.S. Pat. No. Des. 259,947; Des. 259,946; 4,029,242; 3,583,611; and 3,168,972.

Although these holster assemblies generally may be worn in two or more concealed positions, they do not provide the flexibility, ease of attachment and detachment, and stable anchoring positions of the holster that is obtained with the present invention.

SUMMARY OF THE INVENTION

It is the primary object of this invention to provide a universal holster assembly which can be worn under the arm in conjunction with a shoulder harness, attached exteriorly to a belt, or suspended from a belt inside the trousers. The improved holster of this invention includes a body, preferably made of leather, which forms a pocket for receiving a handgun, and which is made up of a muzzle portion, a trigger portion, and a hammer portion. The above references to the various above-mentioned portions of the holster body refer generally to areas of the handgun that are covered by the holster.

Each of the above-mentioned portions of the holster body is provided with a quick release fastener, such as a conventional snap fastener for easy connect and/or disconnect to other holster supporting elements which permit the holster to be worn in the previously mentioned positions. For example, if the holster is to be worn in conjunction with a shoulder harness, the quick release fasteners on the muzzle and hammer portions of the holster are connected to complimentary fasteners on appropriate straps of the harness. In this configuration, an additional elastic strap may be attached between the trigger portion and the wearer's belt to secure the holster in three-point contact so as to prevent undesirable excess rotation of the holster during removal of the handgun.

When the holster is to be worn suspended from the wearer's belt, snap-on loops of material are fastened to the quick release means on the hammer and trigger portions.

An elongated loop and slot are also provided on the holster body for direct connection to the belt.

BRIEF DESCRIPTION OF THE DRAWINGS

FIG. 1 is a side view of a holster in accordance with a preferred embodiment of this invention;

FIG. 4 is an end view of a loop fastener for use with the holster of this invention;

FIG. 5 is a close-up perspective of an elastic connector shown in disconnected relationship to the quick release fastener means provided on the trigger portion of the holster body; and FIG. 6 is a partial cross-sectional view illustrating a belt passing through a loop formed on the holster body.

DESCRIPTION OF THE INVENTION

Figure 2:
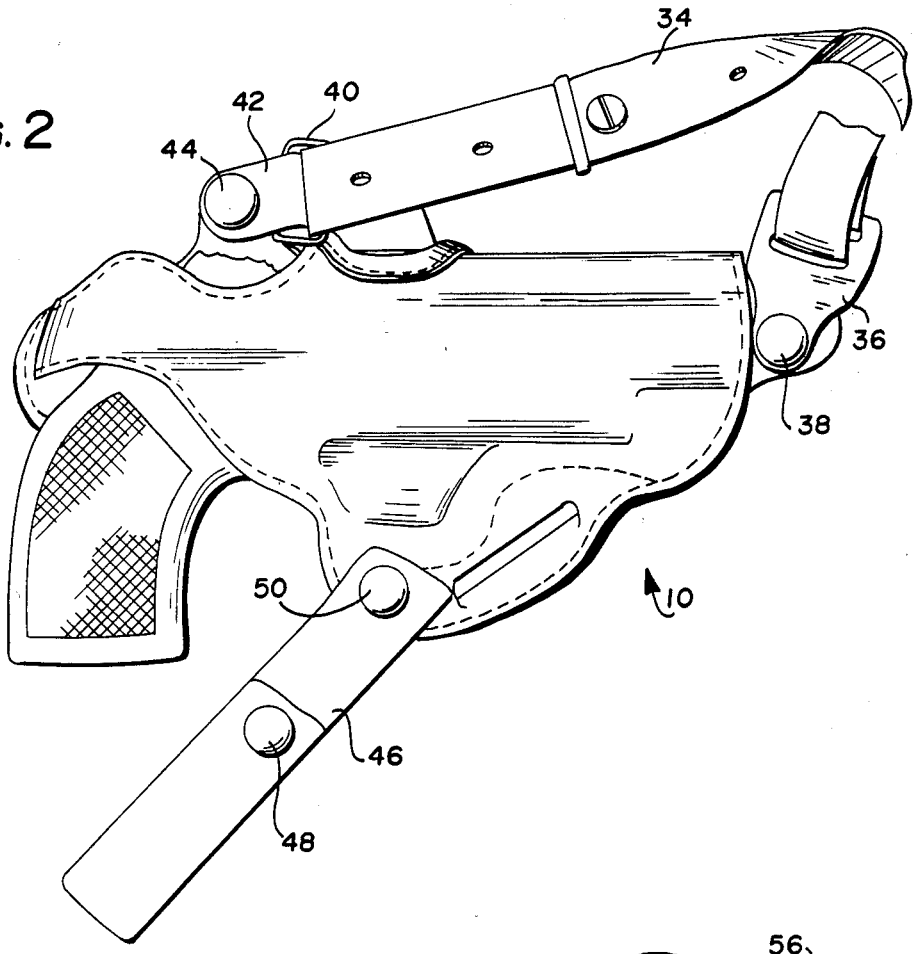
FIG. 2 is a side view also taken from the opposite side of that shown in FIG. 1 and further illustrating connection of the holster to a shoulder harness unit.
Figure 3:
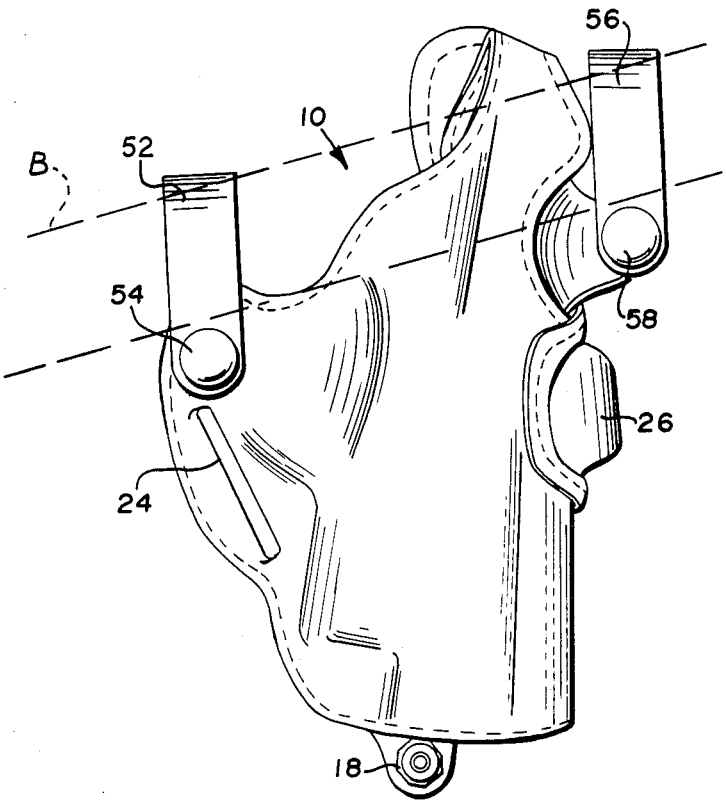
FIG. 3 is a side view taken from the opposite side of the holster shown in FIG. 1, but wherein the holster is provided with quick release loops and fasteners for suspending the holster from a belt.

With further reference to the drawings, there is illustrated in FIGS. 1–3 a universal holster in accordance with the preferred embodiment of this invention. The holster is preferably constructed of leather, but may be constructed of other suitable material as well. In the preferred embodiment, a generally symmetrical piece of relatively stiff leather material is folded over on itself and stitched to form a holster body 10 having a muzzle portion 12, a hammer portion 14 and a trigger portion 16. It is understood that these portions are referenced with respect to a handgun to be received in the pocket as generally illustrated in FIG. 2. Each of the aforesaid portions of the holster body is provided with quick release fastener means 18, 20 and 22, respectively Such fastener means may be of any conventional quick release type, preferably of the snap-on variety.

Also provided within the holster body and isolated from the handgun receiving pocket by the pattern of stitching is an elongated slot 24 Generally aligned with the slot 24, is an additional piece of leather material stitched to the holster body so as to provide an elongated loop 26. The slot 24 and loop 26 are designed to secure the holster body directly to the belt B, (shown in phantom in FIG. 1) of the user outside the trousers.

The hammer portion 14 of the holster body is formed by two generally rearwardly extending tabs 28, 30 which are designed to encircle the hammer portion of the gun and to be fastened to each other by means of a quick release fastener such as is illustrated at 32, which may also be of the snap-on type. It is to be noted that the rearwardly extending tab 28 is, in effect, reinforced by the additional piece of material which forms the elongated loop 26.

With specific reference to FIG. 2, the holster body is shown in a horizontal orientation and attached to a shoulder harness strap 34. The shoulder harness strap 34 may be provided with suitable fastening components 36, 38 at one end and 40, 42, 44 at the other end. Element 38 may be a complimentary snap-on fastener designed for mating engagement with the snap-on fastened 18 as shown in FIG. 1. At the other end of the strap, a conventional D-ring 40 is shown connecting the strap to a looped member 42 provided with a complimentary snap-on fastener 44, which is designed for attachment to the snap-on fastener 20.

Also shown in FIG. 2 is an elastic strap member 46, doubled back on itself and fastened at 48, attached to quick release means 22 by a mating snap-on fastener 50. The elastic strap 46, shown in more detail in FIG. 5, intended to be attached to the user's belt when the holster is worn under the arm in conjunction with a shoulder harness, so as to anchor the holster in a three point contact arrangement which holds the holster in a generally horizontal position and which prevents the holster from undesirable rotation during withdrawal of the handgun. Because snap fastener components are generally able to rotate relative to each other, the three-fastener arrangement nevertheless permits a desirable degree of self-adjustment of the holster.

It is thus seen that the shoulder holster arrangement illustrated in FIG. 2 permits easy connection and disconnection of the holster from the shoulder harness without the necessity of first removing the shoulder harness. Moreover, the elasticity of strap 46 permits the holster to be secured to the belts of users of various sizes.

With reference to FIG. 3, the holster body 10 is shown in a vertical orientation with appropriate fastening loops which allow the holster and handgun to be suspended from a belt B (shown in phantom in FIG. 3) but concealed inside the trousers. Specifically, a fastening loop 52 is shown provided with a fastener 54 attached to the snap fastener 22. A similar fastening loop 56 is shown attached to the snap fastener 20 by a complimentary fastener 58. Again, the use of snap fasteners in conjunction with belt receiving loops facilitates easy connect and disconnect, and permits slight but not excessive movement of the holster.

FIG. 4 illustrates a cross-sectional view of the loop fastener 52 shown in FIG. 3. The fastening loop, preferably also of leather material, is simply looped back on itself and riveted with the snap-on fastener 54.

FIG. 5 illustrates in more detail the elastic fastener 46 shown in FIG. 2 which is intended to be attached to the snap fastener 22 when the holster is used in conjunction with the shoulder harness unit.

In FIG. 6 there is shown a partial sectional view of the holster illustrated in FIG. 1 but wherein a user's belt 56 is received within loop 26. In this arrangement, the holster is secured directly to the user's belt with further utilization of slot 24 but without the need for additional fastener components.

It is also a feature of this invention that the snap fasteners 18, 20 and 22 be located on peripheral portions of the holster body which are outside of the peripheral surfaces of the handgun in its holstered position. In other words, the snap-on fasteners provide no interference for insertion or withdrawal of the handgun from the holster pocket. At the same time, the snap fasteners are permitted to be attached to flat holster surfaces, facilitating connection and disconnection to mating snap fastener elements. It is also a feature of this invention that the snap fastener 22 also serves as a rivet, thereby strengthening the connection of the doubled over portions of the leather material in the area of slot 24.

Easy connection and disconnection of the holster from its mounting components is very advantageous since it allows a user to "check" his gun without unholstering it. A vast number of accidents occur when a handgun is being holstered or unholstered.

While the present invention has been described in what is regarded as its most preferred and most practical embodiment, it will be apparent to those of ordinary sill in the art that various changes and modifications may be made which nevertheless remain within the spirit and scope of the claims which follow.

What is claimed is:

1. A universal holster for carrying a handgun and adapted to be worn in any of a plurality of substantially concealed positions, the holster comprising a holster body providing a pocket for receiving a handgun therein, said pocket comprising a muzzle enclosing portion, trigger enclosing portion and a hammer encircling portion, each of said portions provided with an adjacent associated quick release fastener means for connection to one or more holster supporting elements; said holster body further comprising an elongated slot adapted to receive a belt, said slot and each of said quick release fastener means being located peripherally outside said pocket to facilitate connection and disconnection of the holster to the one or more holster supporting elements.

2. A universal holster as defined in claim 1 wherein said holster further includes material forming a relatively wide loop adjacent the quick release means associated with said hammer encircling portion, and substantially aligned with said elongated, belt receiving slot, whereby said holster may be slidably received on a belt of a user, with said belt passing through said elongated slot and said loop.

3. A universal holster as defined in claim 1, wherein said hammer encircling portion of said holster body includes a pair of tabs.

4. A universal holster as defined in claim 1, wherein each of said quick release fastener means comprises a snap fastener.

5. A universal holster as defined in claim 3, wherein said belt receiving loop comprises additional means for reinforcing one of said tabs.

6. A universal holster as defined in claim 3, wherein said tabs are provided with fastener means for releasably connecting said tabs together to form a closed loop.

7. A universal holster as defined in claim 1 in combination with a shoulder harness means for attachment of the holster to the upper torso of a human body, said harness means including a strap connectable to the quick release fastening means associated with said hammer encircling portion and muzzle enclosing portion, respectively.

8. A universal holster as defined in claim 7 and further comprising an elastic band provided with a belt receiving loop attached to the quick release means associated with said trigger enclosing portion for firmly anchoring the holster at each of said quick release

9. A universal holster as defined in claim 1 in combination with a pair of belt receiving loops, one of which is fastened to the quick release means associated with the hammer encircling portion, and the other of which is fastened to the quick release means associated with the trigger enclosing portion, whereby said holster may be suspended from a user's belt.

10. A universal holster as defined in claim 1, wherein said holster body comprises relatively stiff material folded over on itself and stitched together generally in the area of the trigger portion.

11. A universal holster as defined in claim 10, wherein said quick release fastener means associated with said trigger enclosing portion also comprises a rivet for securing said folded over portions of material.

12. A universal holster as defined in claim 8, wherein each of said quick release fastener means comprises a snap fastener.

13. A universal holster assembly constructed of relatively stiff material folded over on itself and attached along at least a portion of the free edges thereof to form a holster body having a handgun receiving pocket therein, said pocket comprising a muzzle enclosing portion, a trigger enclosing portion and a hammer encircling portion each of said portions having quick release fastener means associated therewith and adapted for connection to one or more holster supporting elements; and wherein each of said quick release fastener means associated with the muzzle enclosing and trigger enclosing portions lie outside the periphery of said pocket to facilitate connection and disconnection of the holster to the one or more holster supporting elements; said holster body further comprising a relatively wide belt receiving loop formed of a separate length of material which also forms at least part of said hammer encircling portion.

14. A universal holster assembly as defined in claim 15 wherein said quick release fastener means comprise snap fasteners.

15. A universal holster assembly as defined in claim 14 wherein said snap fastener associated with said trigger enclosing portion further includes rivet means for further securing said free edges of said relatively stiff material.

16. A universal holster assembly as defined in claim 13 and further comprising an open slot formed in said body adjacent the quick release fastener means associated with the trigger enclosing portion, wherein said slot and said quick release fastener means associated with the trigger enclosing portion are isolated from said pocket.

17. A universal holster assembly as defined in claim 16, wherein said relatively wide belt receiving loop is adjacent the quick release fastener means associated with the hammer portion, and substantially aligned with said open slot, whereby said holster may be slidably received on the belt of a user, said belt passing through said slot and said loop.

18. A universal holster assembly as defined in claim 13, wherein said hammer encircling portion of said holster body includes tabs adapted to encircle an upper portion of the hammer of the handgun.

19. A universal holster assembly as defined in claim 18, wherein said tabs are provided with fastener means for releasably connecting said tabs together to form a closed loop.

20. A universal holster assembly as defined in claim 15 wherein said material is leather.

* * * * *